US010788236B2

(12) United States Patent
Rickard et al.

(10) Patent No.: US 10,788,236 B2
(45) Date of Patent: Sep. 29, 2020

(54) AIR DIFFUSION

(71) Applicant: RICKARD AIR DIFFUSION (PTY) LTD, Ottery (ZA)

(72) Inventors: Mark Gareth Rickard, Ottery (ZA); Dawid Mattys Van Nieuwhuizen, Ottery (ZA); Kirsty Catherine Cox, Ottery (ZA); Emma Margaret Brunette, Ottery (ZA)

(73) Assignee: RICKARD AIR DIFFUSION (PTY) LTD, Ottery (ZA)

( * ) Notice: Subject to any disclaimer, the term of this patent is extended or adjusted under 35 U.S.C. 154(b) by 213 days.

(21) Appl. No.: 15/809,583

(22) Filed: Nov. 10, 2017

(65) Prior Publication Data

US 2018/0135881 A1 May 17, 2018

(30) Foreign Application Priority Data

Nov. 11, 2016 (ZA) ..... 16/7785

(51) Int. Cl.

| | |
|---|---|
| ***F24F 13/06*** | (2006.01) |
| ***F24F 13/10*** | (2006.01) |
| ***F24F 13/16*** | (2006.01) |
| ***F24F 13/12*** | (2006.01) |
| ***F24F 11/79*** | (2018.01) |

(52) U.S. Cl.

CPC ..... *F24F 13/06* (2013.01); *F24F 13/10* (2013.01); *F24F 13/12* (2013.01); *F24F 13/16* (2013.01); *F24F 11/79* (2018.01)

(58) Field of Classification Search

CPC ..... F24F 13/06; F24F 13/10; F24F 13/16

USPC ..... 454/239, 295, 298, 303, 293–294

See application file for complete search history.

(56) References Cited

U.S. PATENT DOCUMENTS

| | | | | |
|---|---|---|---|---|
| 5,058,490 | A * | 10/1991 | Sodec | F24F 13/06 454/289 |
| 7,980,266 | B2 * | 7/2011 | Niedermair | F16K 15/028 137/516.17 |
| 2015/0105013 | A1 * | 4/2015 | Jeong | F24F 1/0007 454/293 |
| 2017/0016633 | A1 * | 1/2017 | Jeon | F24F 1/0014 |

* cited by examiner

*Primary Examiner* — Vivek K Shirsat

(74) *Attorney, Agent, or Firm* — Stephen J. Weyer; Stites & Harbison PLLC

(57) ABSTRACT

A flow of air through a diffuser (10) is controlled by controlling the volumetric flow rate of the flow of air in a control passage, directing the air through a diffusion flow passage, and then either diffusing the air in a first, normal direction, or occasionally diffusing it in a second direction, to dump the air into a room. The air is dumped by operating a dump mechanism (26) to displace a dump element (28,46) from a first diffusion position in which the flow of air is directed in the first diffusion direction, along a ceiling, to a second diffusion position in which the dump element (28,46) redirects the flow of air to dump it.

12 Claims, 13 Drawing Sheets

AIR DIFFUSION

FIELD OF THE INVENTION

This invention relates to air diffusers for use in air conditioning systems.

BACKGROUND TO THE INVENTION

Air diffusers are used to reduce velocity and increase static pressure of air as it is distributed from a heating, ventilation and air conditioning (HVAC) system to a space such as an air-conditioned room. (The space targeted by an HVAC system is referred to as a "room" herein, for the sake of brevity, but the space can take any other form.)

Variable volume air diffusers can regulate the flow-rate of air distributed to the room and the flow-rate can be adjusted manually or automatically, to achieve desired ventilation and/or temperature conditioning.

Many HVAC systems can operate in a "heating mode", to supply hot air to the room, or in a "cooling mode" to supply cold air to the room and the room temperature can be controlled by controlling the volumetric flow of air through a diffuser.

Further to these functions, air diffusers are also often used to distribute air evenly in desired directions as it enters the room—especially to cause a jet of air from the diffuser to attach to a ceiling, taking advantage of the Coandă effect. However, in some instances, it would be desirable to depart from these benefits imparted on the HVAC air supply by the diffuser. In particular, in some instances it may be desirable for air from the HVAC system to flow downwardly into a room. One example is when a cold room needs to be heated rapidly, despite the tendency of hot air to rise. A conventional diffuser would cause hot air from the HVAC system to be accumulate immediately below the ceiling and only gradually to fill the room.

The present invention seeks to provide for selective supply of air to a room with air diffusion, or with air-flow that flows directly into the room with reduced or no diffusion.

The invention seeks to provide said selective supply of air in a cost effective manner, while allowing volumetric control of air flow.

SUMMARY OF THE INVENTION

According to a first aspect of the present invention there is provided an air diffuser comprising:

a body defining at least one control flow passage;

a volume control mechanism including at least one movable element that is displaceable relative to the body, to adjust the size of the control flow passage;

said body defining at least one diffusion flow passage that is in communication with the control flow passage and that is configured to direct flow from the control flow passage in a first diffusion direction; and a dump mechanism comprising at least one dump element that is displaceable between a first diffusion position in which the diffusion flow passage is directed in the first diffusion direction, and a second diffusion position in which the dump element redirects the diffusion flow passage to deviate from the first diffusion direction.

The second diffusion position of the dump element may be within the diffusion flow passage.

The first diffusion position may be a retracted position in which the dump element is substantially clear from the diffusion flow passage and the second diffusion position may be an extended position in which the dump element protrudes at least partly into the diffusion flow passage. The dump element may be retracted into the body in the first diffusion position and may protrude from the body in the second diffusion position.

The dump element may be disposed inside the diffuser body and may be pivotally supported to pivot between its first diffusion position and its second diffusion position.

The dump element may close a second flow passage at least in part, and restrict a flow of air to the diffusion flow passage when the dump element is in the first diffusion position, and may open the second flow passage and permit the flow of air to deviate, at least in part, from the diffusion flow passage to the second flow passage when the dump element is in the second diffusion position.

The dump mechanism may include a dump actuator that is configured to displace the dump element between the first diffusion position and the second diffusion position and the dump element may be biased to the first diffusion position.

According to another aspect of the present invention there is provided a method of controlling a flow of air through a diffuser, said method comprising:

supplying a flow of air to a diffuser;

directing the flow of air through a control flow passage;

controlling the volumetric flow rate of the flow of air;

directing the flow of air through a diffusion flow passage;

directing the flow of air from the diffusion flow passage in a first diffusion direction;

selectively operating a dump mechanism to displace a dump element from a first diffusion position in which the flow of air is directed in the first diffusion direction, to a second diffusion position in which the dump element redirects the flow of air to deviate from the first diffusion direction.

The first diffusion direction may extend in the proximity of a ceiling and the step of operating the dump mechanism may include displacing the dump element to the second diffusion position to redirect the flow of air away from the ceiling.

The method may include controlling the volumetric flow rate while the flow of air is deviated from the first diffusion direction by the dump element.

BRIEF DESCRIPTION OF THE DRAWINGS

For a better understanding of the present invention, and to show how it may be carried into effect, the invention will now be described by way of non-limiting example, with reference to the accompanying drawings in which.

DETAILED DESCRIPTION OF THE DRAWINGS

Figure 1:
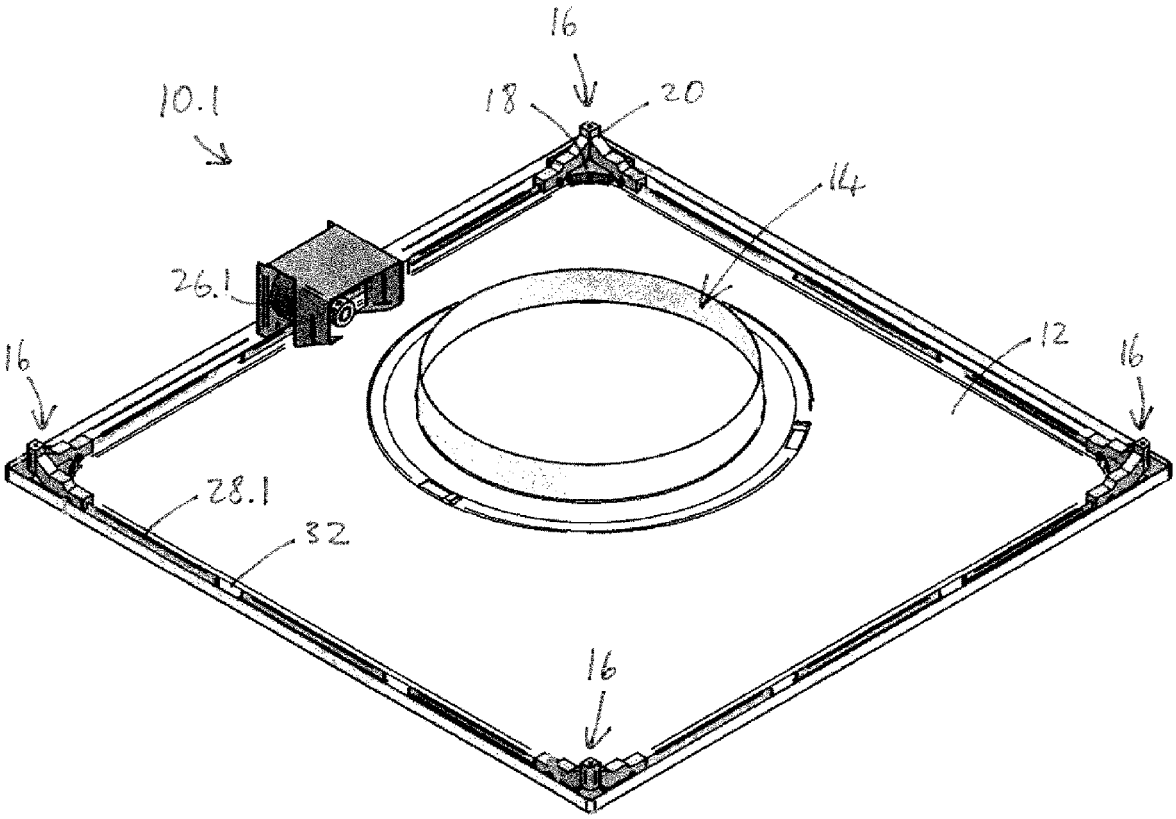
FIG. 1 shows a top three-dimensional view of a first embodiment of an air diffuser according to the present invention.

Referring to the drawings, an air diffuser in accordance with the present invention is generally indicated by reference numeral 10. Features that are common between different embodiments of diffusers according to the invention are identified by the same reference numbers and where applicable, different embodiments of the diffusers or features are identified by suffixes.

Referring to FIGS. 1 to 5, the air diffuser 10.1 includes a body in the form of a casing 12 that is configured to be supported as part of a suspended ceiling, receiving air from an HVAC system above the ceiling. The casing 12 defines an internal control flow passage that extends from a central inlet 14, which forms a truncated cylindrical neck at the top of the casing, downwards to an outlet on the underside of the casing (not visible in the drawings). The outlet is typically defined around the periphery of a central trim plate (not visible in the drawings), which is generally flush with the underside of the casing.

The diffuser 10.1 includes a volume control mechanism that includes a movable element such as a baffle or control disc (not visible in the drawings) that is displaceable inside the casing 12 to increase or decrease the size of the control flow passage, to control the flow of air from the HVAC system, that flows from the inlet 14 and is discharged to the room below, through the outlet of the diffuser 10.1.

On the underside of the casing 12, the diffuser 10.1 defines a diffusion flow passage, which extends from the outlet (around the periphery of the trim plate), outwards in a first diffusion direction along the underside of the casing. Air that exits the diffuser 10.1 along this diffusion flow passage would tend to continue flowing outwards beyond the periphery of the diffuser, along the underside of an adjacent ceiling, by operation of the Coandă effect.

Above each corner of the casing 12, a support mechanism 16 is provided, which includes a base 18 that is attached to the casing and a hanger 20 that is supported above the base. The base 18 has an upstanding hollow pin 22 on which the hanger 20 is received and the hanger is supported by a compression helical spring (not shown) that extends between the pin and the hanger. A passage 24 is defined inside the base 18 and pin 22, along which a cable (not shown) can extend to be attached to the hanger 20, so that tension on the cable would pull the hanger downwards relative to the base 18, against the upward bias of the spring.

Cables that extend to each of the four support mechanisms 16 are connected together to form a harness that is connected to a dump actuator in the form of a stepper motor 26.1, so that rotation of the stepper motor causes a cable from the harness to be wound around a pulley and to apply tension to the entire harness. Tension in the harness is transferred to the cables in the passages 24 of each of the support assemblies 16 and causes them to pull the hangers 20 downwards, simultaneously.

Four dump elements in the form of narrow blades 28.1 are each supported at their opposing ends, by two of the hangers 20. The stepper motor 26.1, harness of cables, hangers 20 and blades 28.1 operate as a dump mechanism, such that the blades move up and down in unison with the hangers, when the stepper motor 26.1 applies tension to the cable harness.

Figure 2:
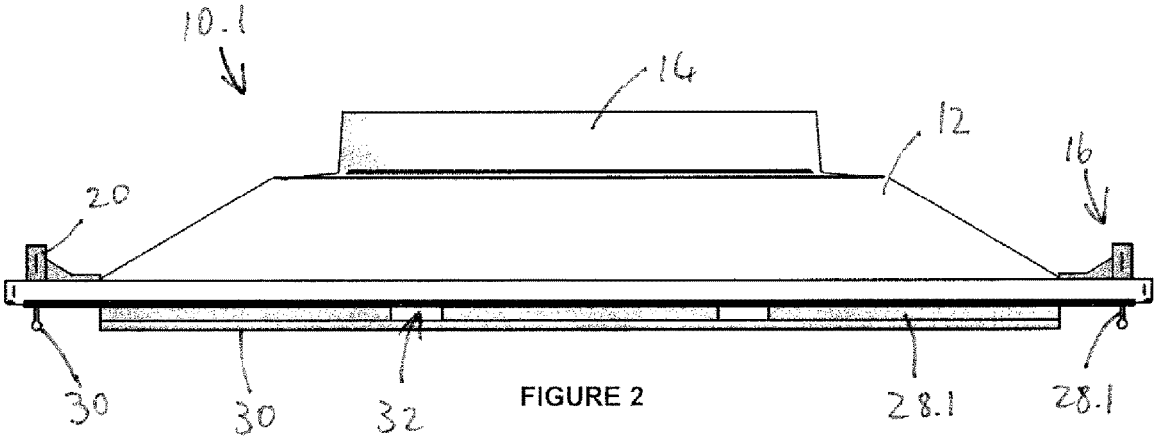
FIG. 2 shows a side view of the diffuser of FIG. 1.
Figure 3:
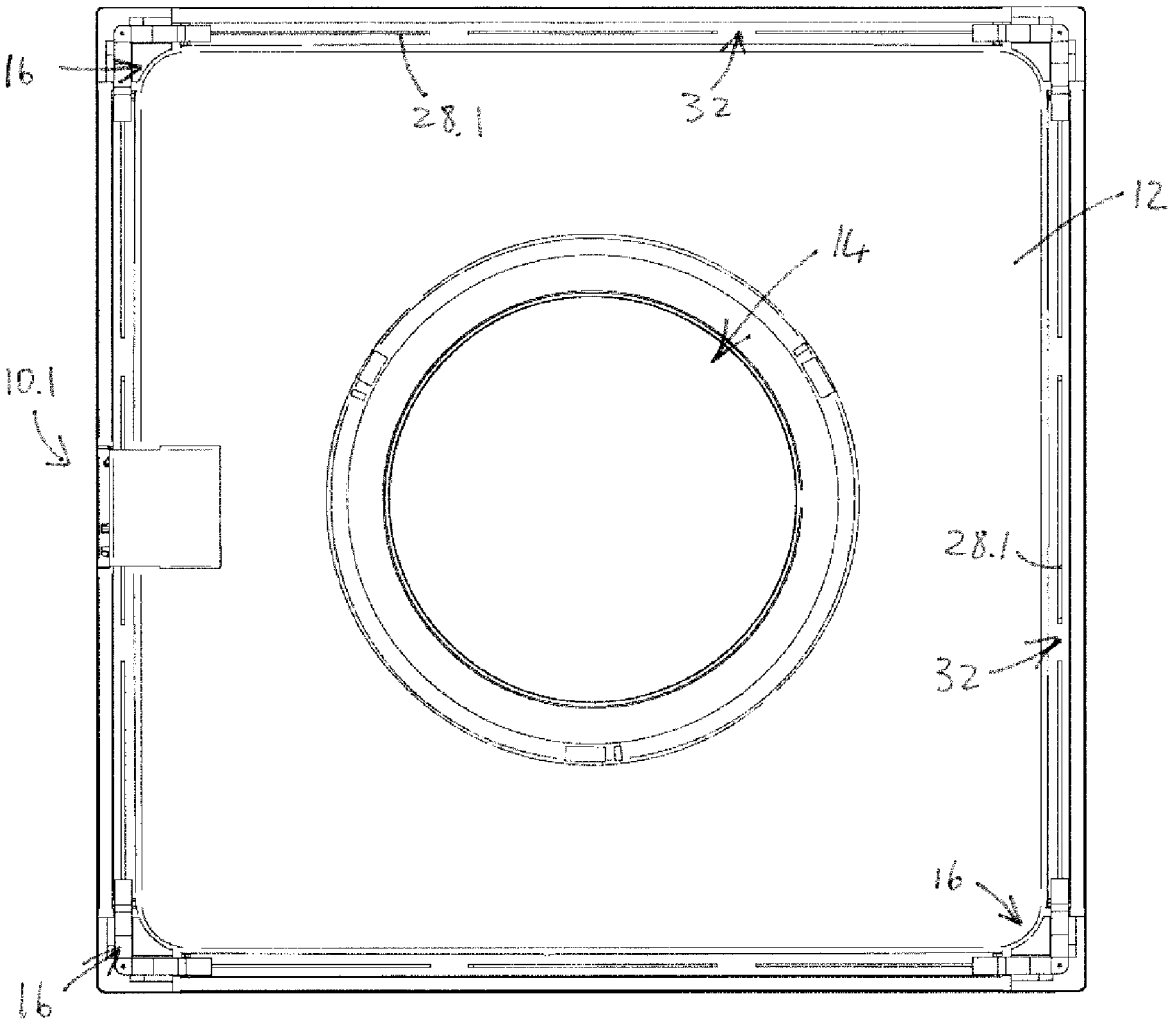
FIG. 3 shows a top view of the diffuser of FIG. 1.
Figure 4:
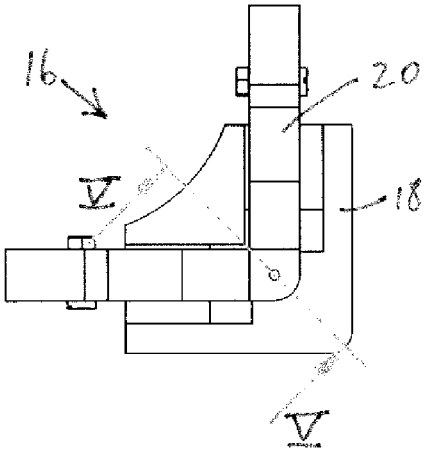
FIG. 4 shows a detail top view of a support assembly of the diffuser of FIG. 1.
Figure 5:
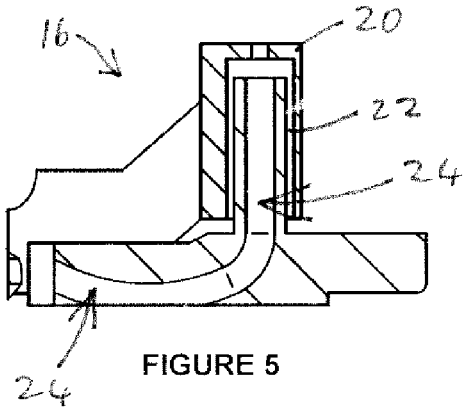
FIG. 5 shows a sectional view of the support assembly of FIG. 4, taken at V-V.

The casing 12 defines four slots along its periphery and each of the blades 28.1 is configured to slide vertically in its associated slot between a retracted or first diffusion position, in which each blade is substantially above the underside of the casing 12, and an extended or second diffusion position in which most of each blade protrudes below the underside of the casing, as shown in FIG. 2.

During normal operation of the diffuser 10.1, the cable harness is not under tension and the springs bias the hangers 20 and blades 28.1 upwards, so that the blades are in their retracted positions, in which they are clear of the diffusion flow passage and allow the air in the diffusion flow passage to flow in the first diffusion direction, outwardly from the underside of the casing 12 and along the underside of the adjacent ceiling. The diffuser 10.1 operates in this condition, in a conventional manner, with volumetric control of the air flow-rate and with diffusion of the air.

In the event that a downward flow of air from the diffuser 10.1 is required, the stepper motor 26.1 is operated to pull the cable harness and to pull the hangers 20 and blades 28.1 downwards into their extended positions, with the blades protruding below the underside of the casing 12, along the periphery of the casing. The lower edges of the blades 28.1 protrude into the diffusion flow passage and disrupts the outward flow of air along the undersides of the casing 12 and ceiling and instead, redirects the air to deviate from the first diffusion direction and to flow downwards in a second diffusion direction.

The redirection of the air flow by the blades 28.1 in their extended positions, is enhanced by rib formations 30 along the bottom edges of the blades. In the embodiment illustrated in FIGS. 1 to 5, the rib formations 30 extend continuously along the entire lower edge of each blade 28.1, while the upper part of the blade is discontinuous and defines two gaps 32.

When the downward (dumping) flow of air is no longer required, the stepper motor 26.1 is operated to relieve tension on the cable harness and the bias in the springs causes the hangers 20 to lift and to retract the blades into their retracted positions—substantially retracted into the underside of the casing 12.

Referring to FIGS. 6 to 9, the second embodiment of a diffuser 10.2 according to the present invention includes a casing 12 with an inlet 14, where it receives a supply of air from an HVAC system. At the bottom of the casing, a fixed central trim plate 34.2 is supported generally flush with the underside of the casing and with the adjacent ceiling, with an outlet 36 defined around the circumference of the trim plate. A control disc (not shown) can be supported inside the casing 12, above the trim plate 34 and form part of a volume control mechanism of the diffuser 10.2, the trim plate being moveable up and down inside the casing to adjust the size of the control flow passage that extends from the inlet 14 to the circumference of the control disc. Instead, the diffuser 10.2 could include a rotating control disc 40.2 inside the casing 12, below the inlet 14, which rotates to adjust the size of the flow passage by varying the extent to which apertures in a fixed plate and in the control disc, overlap.

At the outlet 36, the diffuser 10.2 defines a diffusion flow passage, which extends from the circumference of the control disc and trim plate 34.2, outwards in a first diffusion direction along the underside of the casing. Air that exits the diffuser 10.2 along this diffusion flow passage would tend to continue flowing outwards beyond the periphery of the diffuser, along the underside of an adjacent ceiling, by operation of the Coandă effect, as shown in FIG. 7.

The diffuser 10.2 includes a dump mechanism comprising four dump elements in the form of blades 28.2 that are each supported transversely at the end of a bar 38. The dump mechanism includes an actuator in the form of stepper motor 26.2 with a pinion (not shown) that meshes with linear gear teeth on each of the bars 38 in rack-and-pinion fashion, so that rotation of the stepper motor drives each of the bars 38 to travel longitudinally inwards or outwards, simultaneously, in directions oriented at right angles relative to one another.

Figure 6:
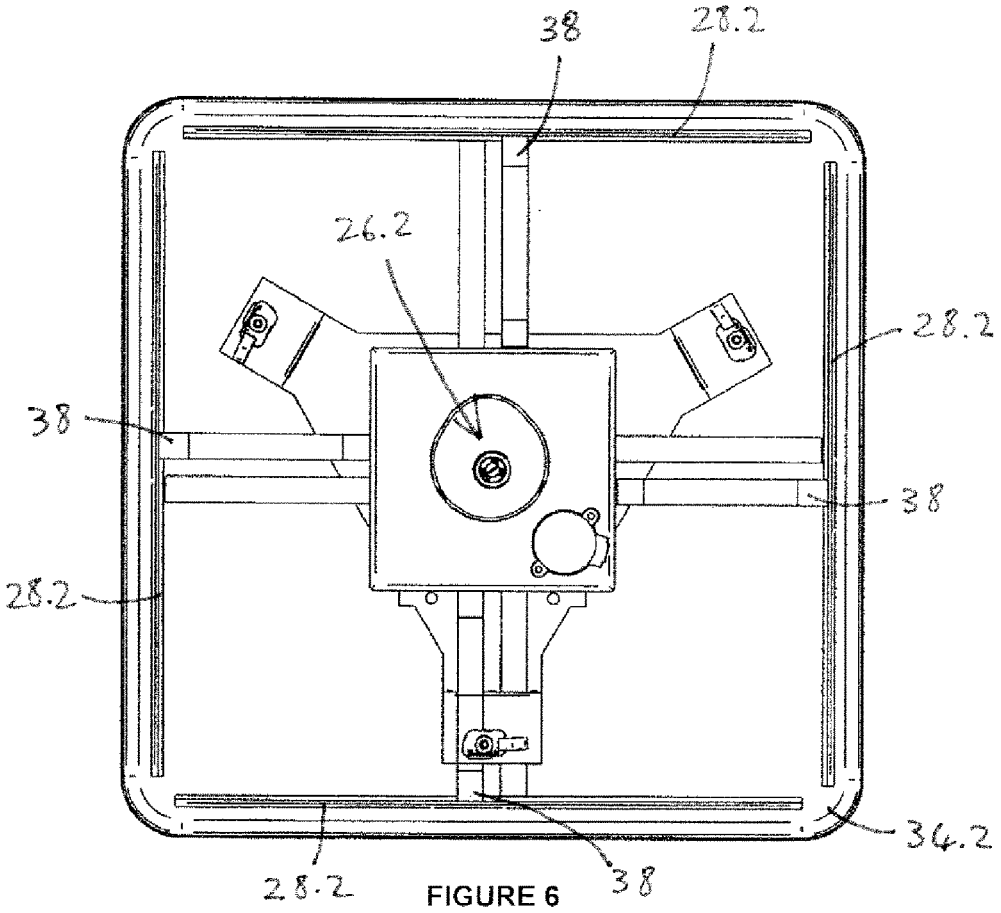
FIG. 6 shows a top view of a dump mechanism of a second embodiment of an air diffuser according to the present invention, in a first diffusion condition.
Figure 7:
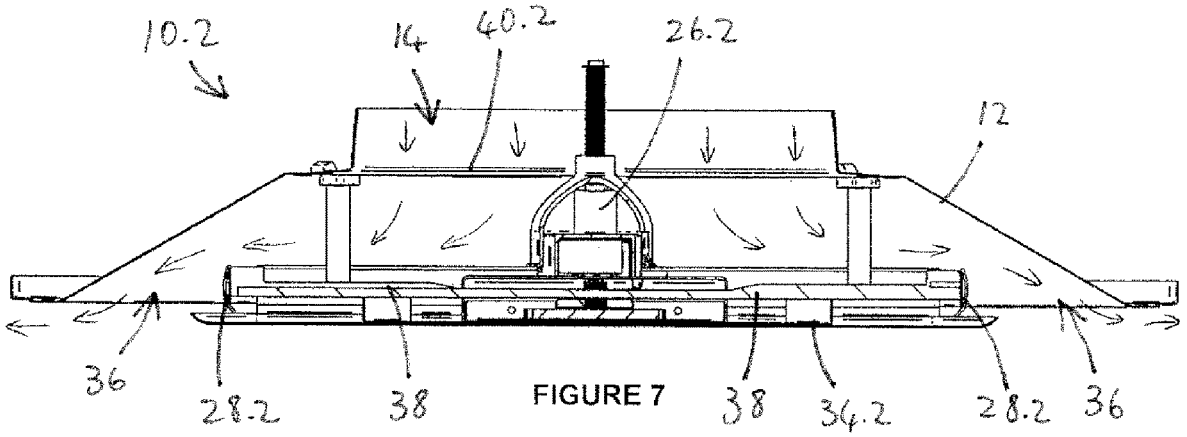
FIG. 7 shows a sectional side view of a the second embodiment of an air diffuser according to the present invention, in the first diffusion condition.

During normal operation of the diffuser 10.2, the blades 28.2 are in first diffusion positions or retracted positions as shown in FIGS. 6 and 7, in which they are retracted behind the trim plate 34.2 and are substantially clear of the diffusion flow passage, so that they allow the air in the diffusion flow passage to flow in the first diffusion direction, outwardly from the underside of the casing 12 and along the underside of the adjacent ceiling, as shown in FIGS. 6 an 7. The diffuser 10.2 operates in this condition, in a conventional manner, with volumetric control of the air flow-rate by operation of the control disc 40.2, and with diffusion of the air.

Figure 8:
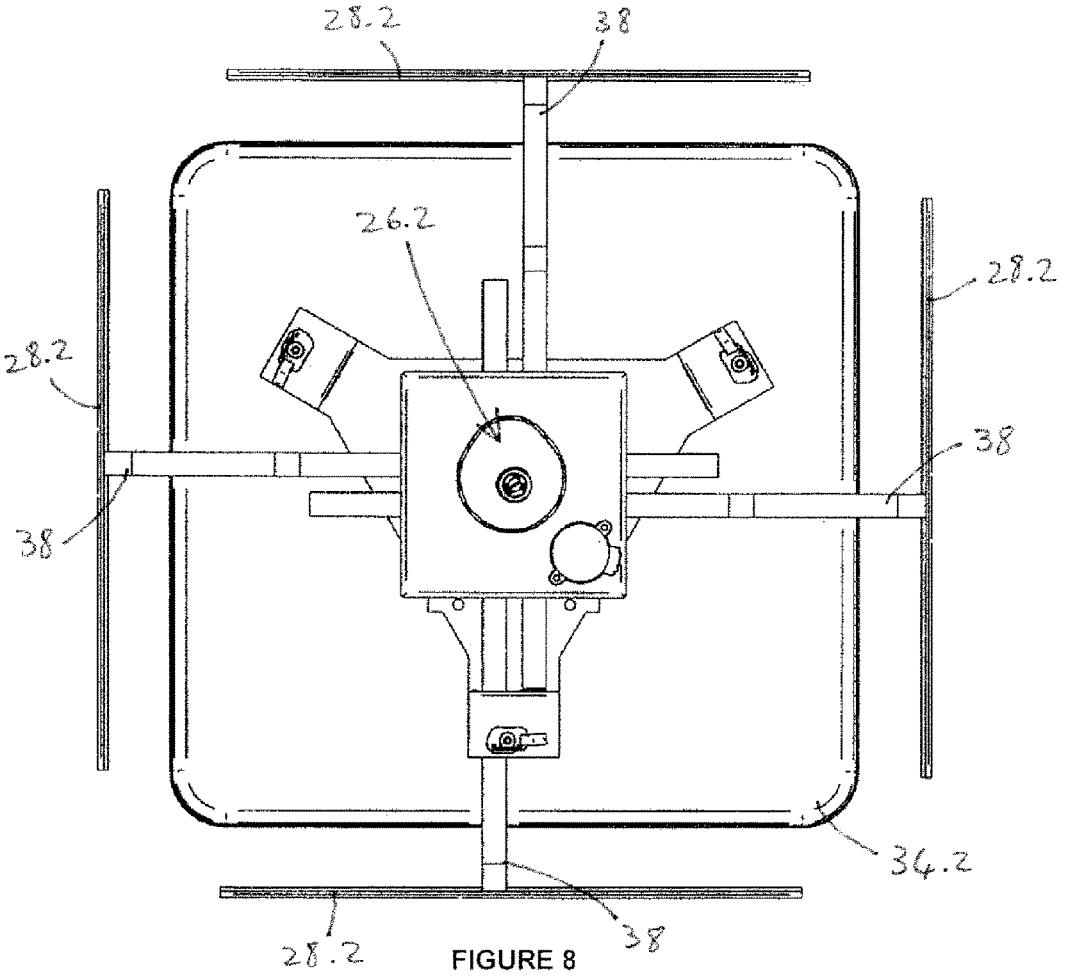
FIG. 8 shows a top view of the dump mechanism of FIG. 6, in a second diffusion (dumping) condition.
Figure 9:
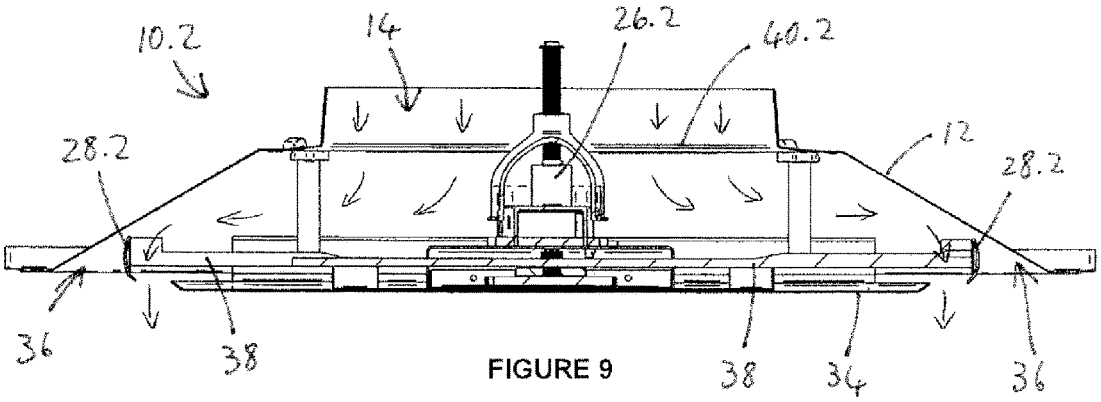
FIG. 9 shows a sectional side view of a the diffuser of FIG. 7, in the second diffusion (dumping) condition.

In the event that a downward flow of air from the diffuser 10.2 is required, the stepper motor 26.2 is operated to push the bars 38 outwards and push the blades 28.2 outwards into second diffusion or extended positions in which the blades protrude beyond the periphery of the trim plate 34.2, as shown in FIGS. 8 and 9. The blades 28.2 protrude into the diffusion flow passage and disrupts the outward flow of air as it exits the outlet 36 and redirects the air to deviate from the first diffusion direction and to flow downwards in a second diffusion direction, as shown in FIGS. 8 and 9.

While the diffuser 10.2 is in this second diffusion or dumping condition, the volumetric control of airflow-rate continues in the conventional manner by operation of the control disc 40.2.

Once the need for downward flow or air from the diffuser 10.2 ceases, the stepper motor 26.2 is operated to draw the bars 38 and the blades 28.2 inwards to return the blades to their retracted positions as shown in FIGS. 6 and 7, and normal operation of the diffuser 10.2 can resume.

Referring to FIGS. 10 to 13, the third embodiment of a diffuser 10.3 according to the present invention includes some features that are very similar to those of the second embodiment, shown in FIGS. 6 to 9, including: a casing 12 with an inlet 14, a volume control mechanism including a rotating control disc 40.3, an outlet 36 around a trim plate 34.3 (although the trim plate is quite different—see below), where the diffuser 10.3 defines a diffusion flow passage, which extends from the circumference of the trim plate 34.3, outwards in a first diffusion direction along the underside of the casing. An internal casing 42 is also shown in FIGS. 10 to 13, which supports the control disc 40.3, with windows 44 in the internal casing, through which air can flow.

Figure 10:
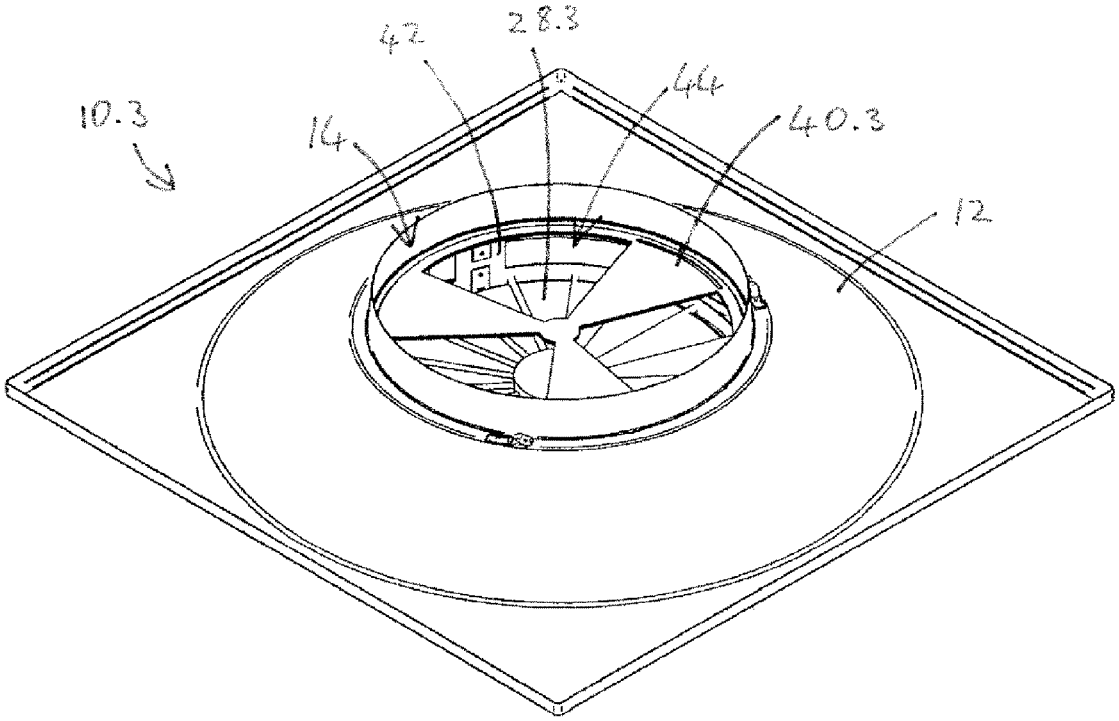
FIG. 10 shows a three-dimensional top view of a third embodiment of an air diffuser according to the present invention.
Figure 11:
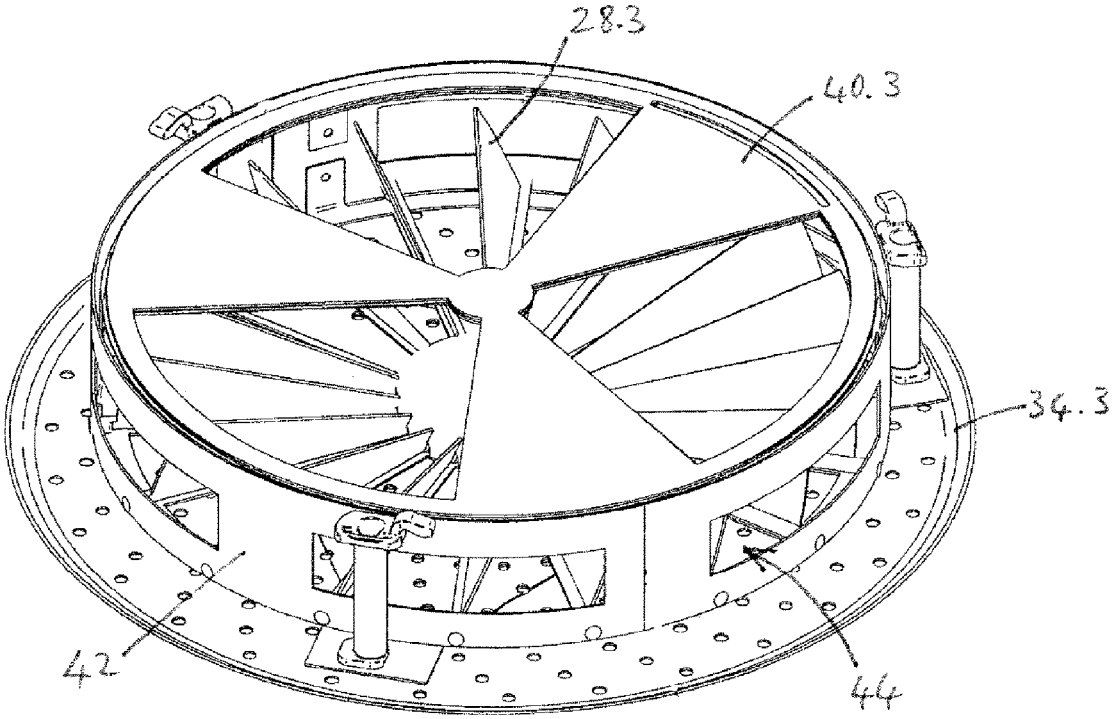
FIG. 11 shows a three-dimensional top view of a volume control mechanism and dump mechanism of the diffuser of FIG. 10.

FIGS. 10 and 11 shows the volume control mechanism of the diffuser 10.3, in which the control disc 40.3 is in register with a stationary plate in an open condition, with apertures defined in the control disc and the stationary plate, in register. Each aperture is almost twice the width of the adjacent solid part of the control disc 40.3 and an intermediary disc (not visible) is provided between the control disc and stationary disc, which is shaped similarly to the control disc and stationary disc. When the control disc 40.3 rotates to a closed position, the intermediate disc rotates with it for a part of the rotation, so that the apertures in the stationary plate are partly closed by the control disc and partly by the intermediary disc.

Figure 12:
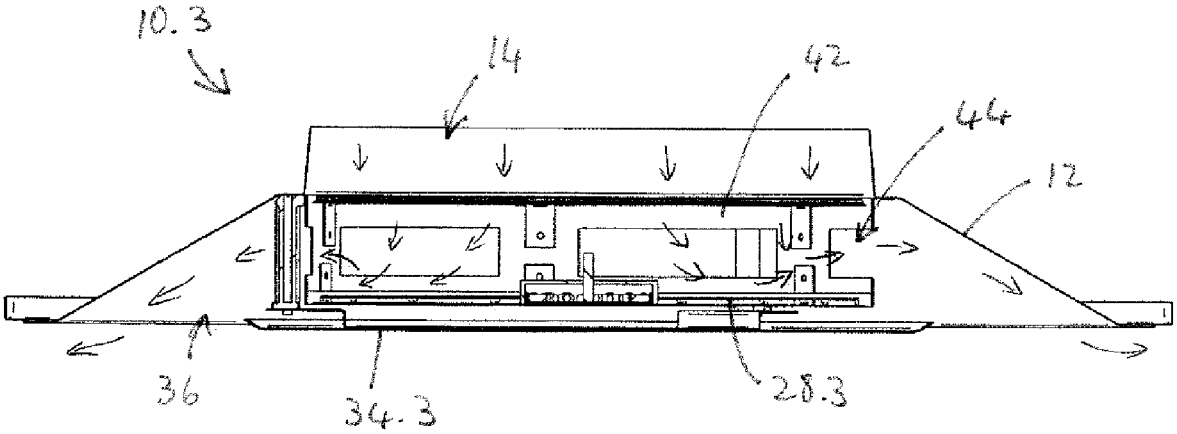
FIG. 12 shows a sectional side view of the diffuser of FIG. 10, in a first diffusion condition.
Figure 13:
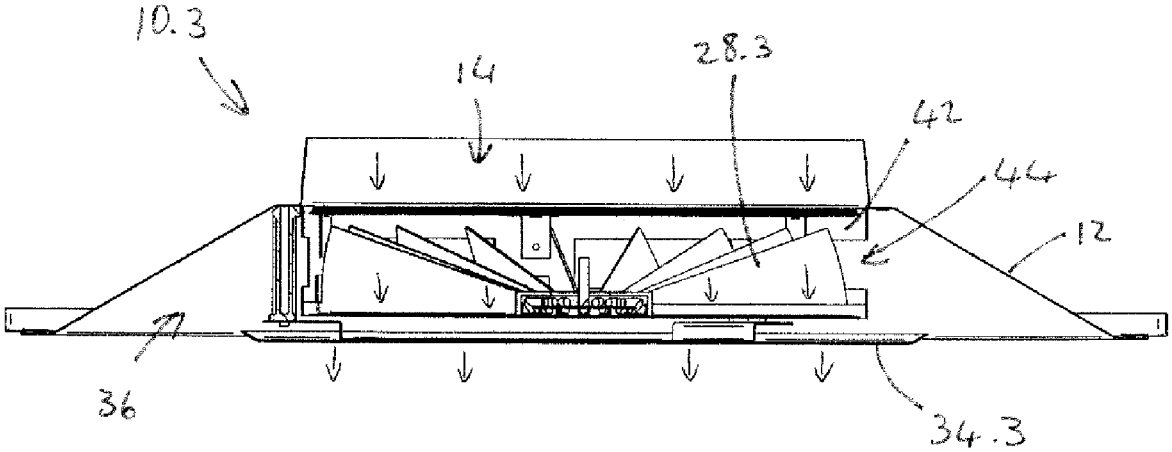
FIG. 13 shows a sectional side view of the diffuser of FIG. 10, in a second diffusion (dumping) condition.
Figure 14:
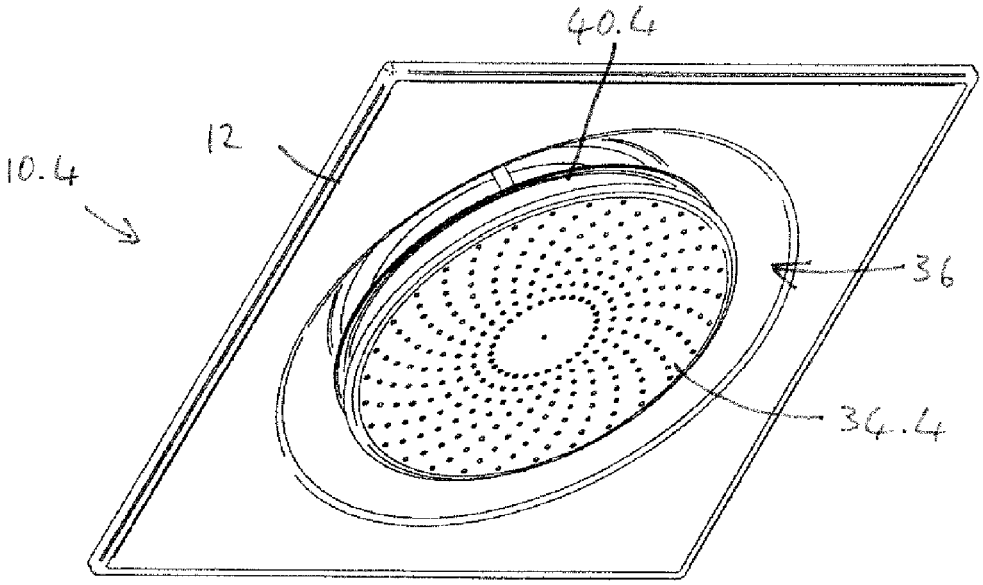
FIG. 14 shows a three-dimensional bottom view of a fourth embodiment of an air diffuser according to the present invention.

The diffuser 10.3 includes a dump mechanism comprising a perforated trim plate 34.3 and an array of blades 28.3 that extend in a radial arrangement above the trim plate. Each of the blades 28.3 is pivotally supported above the trim plate 34.3 to pivot between a first or closed position in which the blades lie flat against the trim plate in a side-by-side arrangement, blocking the perforations in the trim plate as shown in FIGS. 10 and 12, and a second or open position in which the blades extend upwards and do not obstruct the perforations of the trim plate, as shown in FIGS. 11 and 13. The dump mechanism includes an actuator in the form of stepper motor (not shown) that is configured to pivot the blades 28.3 in unison between their open and closed positions.

During normal operation of the diffuser 10.3, the blades 28.3 are in their closed positions as shown in FIGS. 10 and 12, in which they obstruct the perforations in the trim plate 34.3, so that air flows in the diffusion flow passage in the first diffusion direction, outwardly from the underside of the casing 12 and along the underside of the adjacent ceiling, as shown in FIG. 12. The diffuser 10.3 operates in this condition, in a conventional manner, with volumetric control of the air flow-rate by operation of the control disc 40.3, and with diffusion of the air.

In the event that a downward flow of air from the diffuser 10.3 is required, the stepper motor is operated to pivot the blades 28.3 upwards to their open positions as shown in FIGS. 11 and 13. The apertures in the trim plate 34.3 are thus no longer obstructed by the blades 28.3 and the outward flow of air as it exits the outlet 36 is disrupted, at least in part, because the air is redirected by the blades to deviate from the first diffusion direction and to flow downwards in a second diffusion direction, through the perforations of the trim plate, as shown in FIG. 13.

While the diffuser 10.3 is in this second diffusion or dumping condition, the volumetric control of airflow-rate continues in the conventional manner by operation of the control disc 40.3.

Once the need for downward flow or air from the diffuser 10.3 ceases, the stepper motor is operated to pivot the blades 28.3 downwards to return them to their closed positions as shown in FIGS. 10 and 12, and normal operation of the diffuser 10.3 can resume.

Referring to FIGS. 14 to 18, the fourth embodiment of a diffuser 10.4 according to the present invention includes some features that are very similar to those of the third embodiment shown in FIGS. 10 to 13, such as: a casing 12 with an inlet 14, a perforated trim plate 34.4 and an outlet 36 around a trim plate, where the diffuser 10.4 defines a diffusion flow passage, which extends from the circumference of the trim plate, outwards in a first diffusion direction along the underside of the casing.

The diffuser 10.4 also includes a volume control mechanism comprising a control disc 40.4 that is moved up and down inside the casing 12 in the control flow passage, between that inlet 14 and the trim plate 34.4, to control the size of the flow passage and thus control the volume of air flow through the diffuser.

Figure 15:
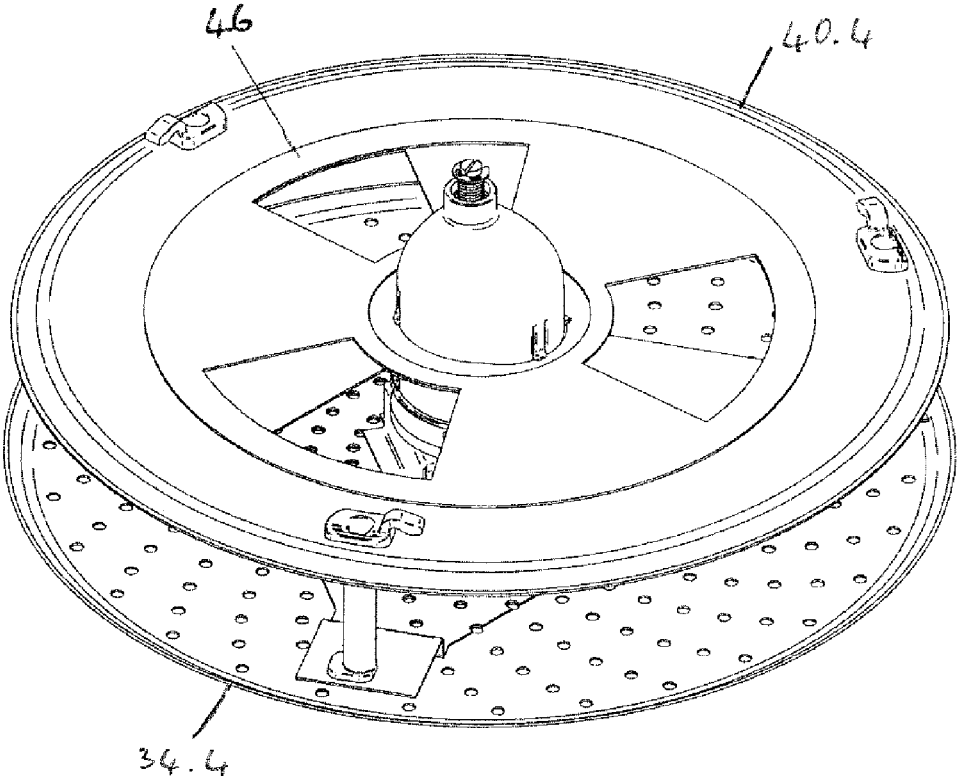
FIG. 15 shows a three-dimensional top view of a volume control mechanism and dump mechanism of the diffuser of FIG. 14.

As best seen in FIG. 15, the control disc 40.4 also includes a dump mechanism comprising a dump disc 46 that is rotatable relative to the control disc. Each of the control disc 40.4 and dump disc 46 defines apertures in them and the dump disc can rotate between a first or closed position in which the apertures of the control disc are closed by the dump disc, and a second or open position in which the apertures of the control disc and dump disc are in register and are open. The dump mechanism includes an actuator in the form of stepper motor (not shown) that is configured to rotate the dump disc 46 relative to the control disc 40.4.

Figure 16:
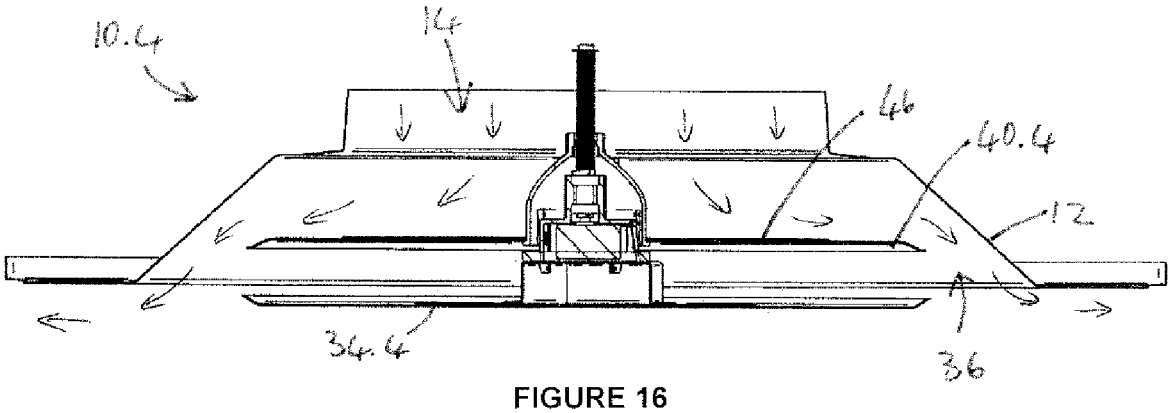
FIG. 16 shows a sectional side view of the diffuser of FIG. 14, in a first diffusion condition, with its volume control open.
Figure 17:
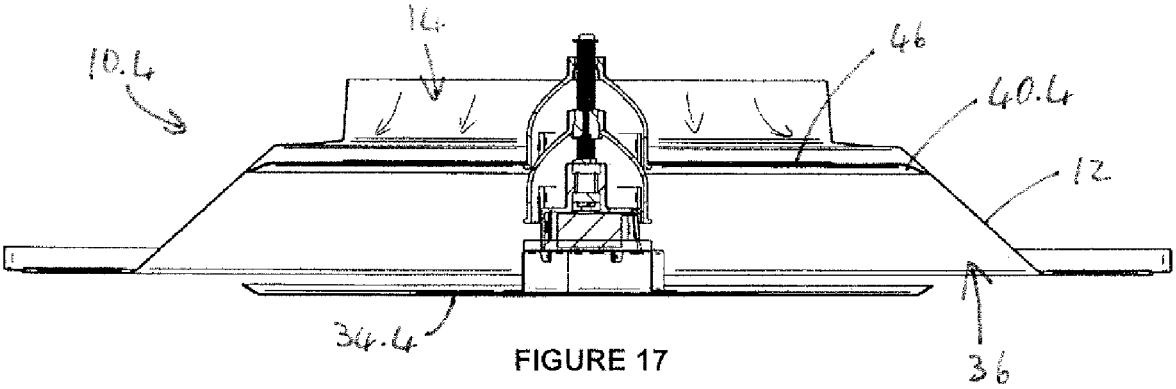
FIG. 17 shows a sectional side view of the diffuser of FIG. 14, in a first diffusion condition, with its volume control closed.

During normal operation of the diffuser 10.4, the dump disc 46 is in its closed position as shown in FIGS. 16 and 17, in which it obstructs the apertures in the control disc 40.4, so that air flows in the diffusion flow passage in the first diffusion direction, outwardly from the underside of the casing 12 and along the underside of the adjacent ceiling, as shown in FIG. 16. The diffuser 10.4 operates in this condition, in a conventional manner, with diffusion of the air and with volumetric control of the air flow-rate by operation of the control disc 40.4, which moves between an open position as shown in FIG. 16, where air passes between the casing 12 and the circumference of the control disc, and a closed position as shown in FIG. 17, in which the circumference of the control disc seals against the casing 12.

Figure 18:
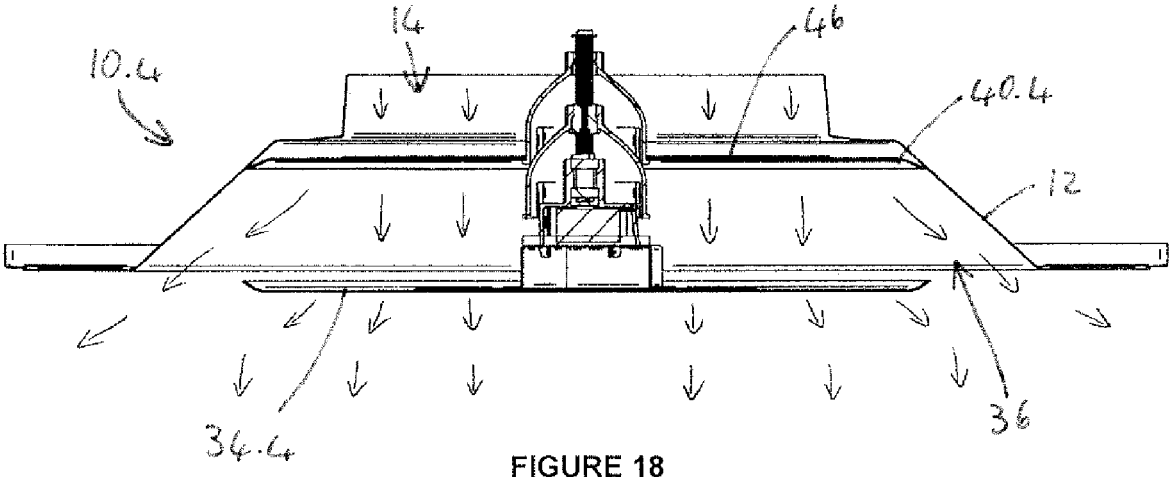
FIG. 18 shows a sectional side view of the diffuser of FIG. 14, in a second diffusion (dumping) condition.
Figure 19:
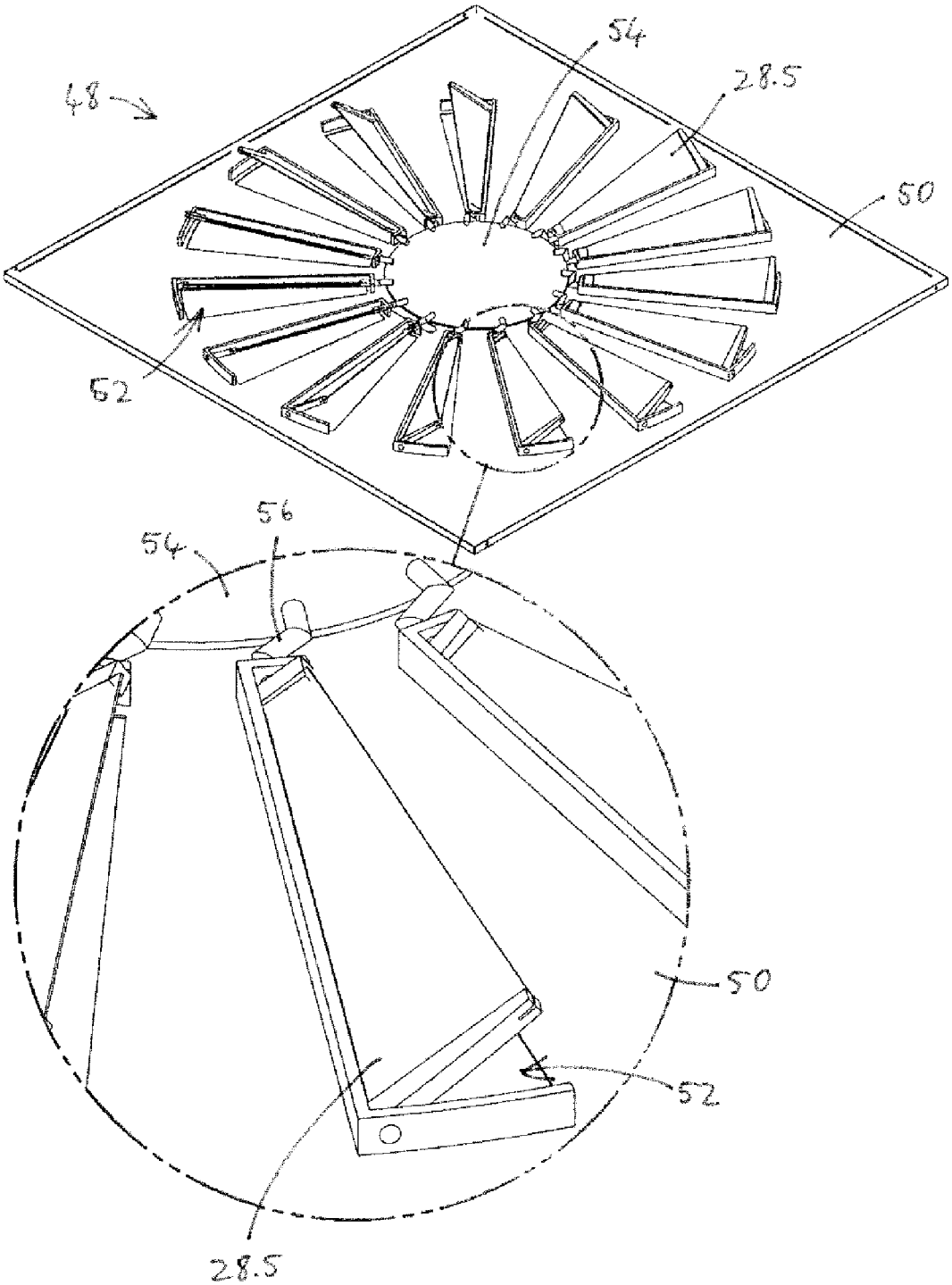
FIG. 19 shows a three-dimensional top view of a blade sub-assembly of a fifth embodiment of an air diffuser according to the present invention, including a detail view.

In the event that a downward flow of air from the diffuser 10.4 is required, the control disc 40.4 is moved upwards to its closed position and the dump disc 46 is rotated to open the apertures in the control disc and allow air to flow downward through these apertures, as shown in FIG. 18. The air is thus no longer only directed to a gap between the circumference of the control disc 40.4 and the casing 12 and to flow outwards through the outlet 36 in a first diffusion direction, but a large part of this flow is disrupted and the air is redirected to flow downwards in a second diffusion direction, through the apertures in the control disc and through the perforations of the trim plate 34.4.

While the diffuser 10.4 is in this second diffusion or dumping condition, the volumetric control of air flow-rate is achieved by controlled rotation of the dump disc 46 in relation to the control disc 40.4, to regulate the degree by which the apertures in these two discs overlap.

Once the need for downward flow or air from the diffuser 10.4 ceases, the dump disc 46 is rotated to return to its closed positions as shown in FIGS. 16 and 17, and normal operation of the diffuser 10.4 can resume.

Referring to FIGS. 19 to 22, the fifth embodiment of a diffuser 10.5 according to the present invention includes a casing 12.5 that differs somewhat from the first four embodiments, although it also has an inlet 14 or neck at its top and at its bottom, the casing defines an outlet 36.5 that is partially closed by a blade sub-assembly 48.

The blade sub-assembly 48 includes a base plate 50 that extends across the outlet 36.5 of the casing 12.5 and that is typically installed generally aligned with the ceiling. An array of radial outlet apertures 52 are defined in the base plate 50 in a radial pattern and an array of blades 28.5 are pivotally mounted on the base plate and are each pivotable between a closed condition in which each blade closes its associated outlet aperture as shown in FIG. 21, an intermediate position in which each blade extends at an acute angle relative to the base plate and its associated outlet aperture is open as shown in FIG. 20, and a fully open position in which each blade extends generally upright relative to the base plate and its associated outlet aperture is open, as shown in FIG. 22.

Each of the blades 28.5 is attached to a central disc 54 by a crank arm 56, so that up-and-down movement of the central disc pivots all the blades in unison, in crank-fashion between their closed, intermediate and open positions. Up and down movement of the central disc 54 is affected by operation of a stepper motor (not shown).

The diffuser 10.5 includes a volume control mechanism and a dump mechanism, but both these mechanisms comprise of the same equipment, operated in different modes. The stepper motor, central disc 54, crank arms 56, blades 28.5 and base plate 50 with its apertures 52, make up the volume control mechanism and the dump mechanism.

Figure 20:
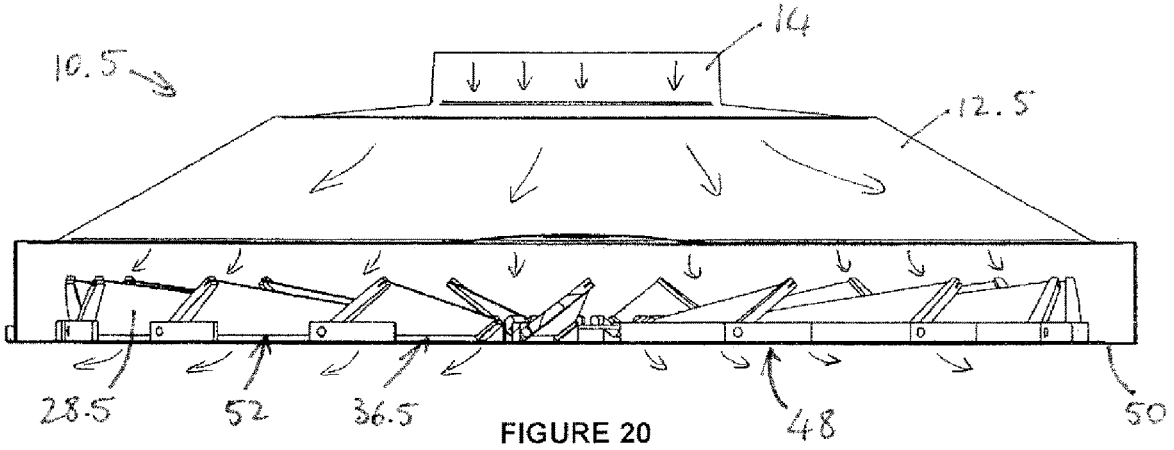
FIG. 20 shows a sectional side view of the diffuser of FIG. 19, in a first diffusion condition, with its volume control open.
Figure 21:
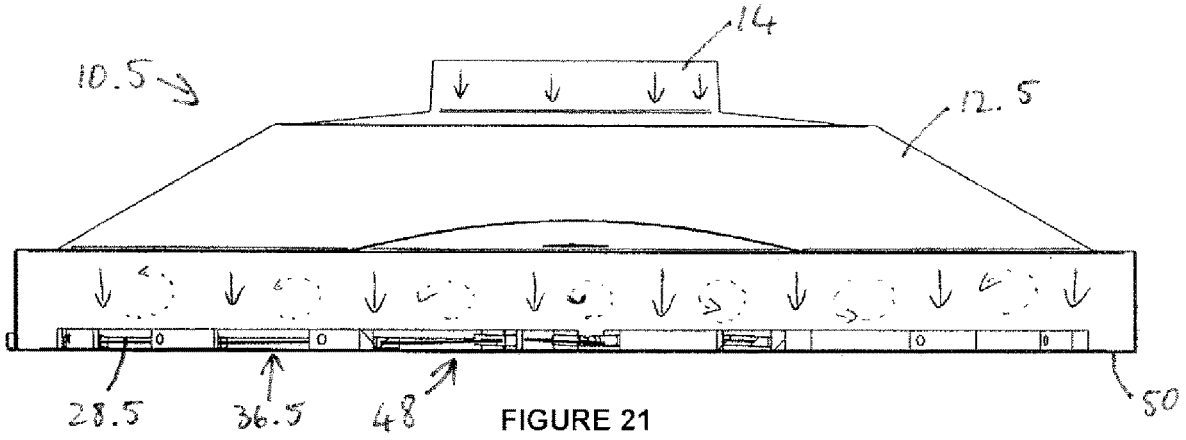
FIG. 21 shows a sectional side view of the diffuser of FIG. 19, in a first diffusion condition, with its volume control closed.
Figure 22:
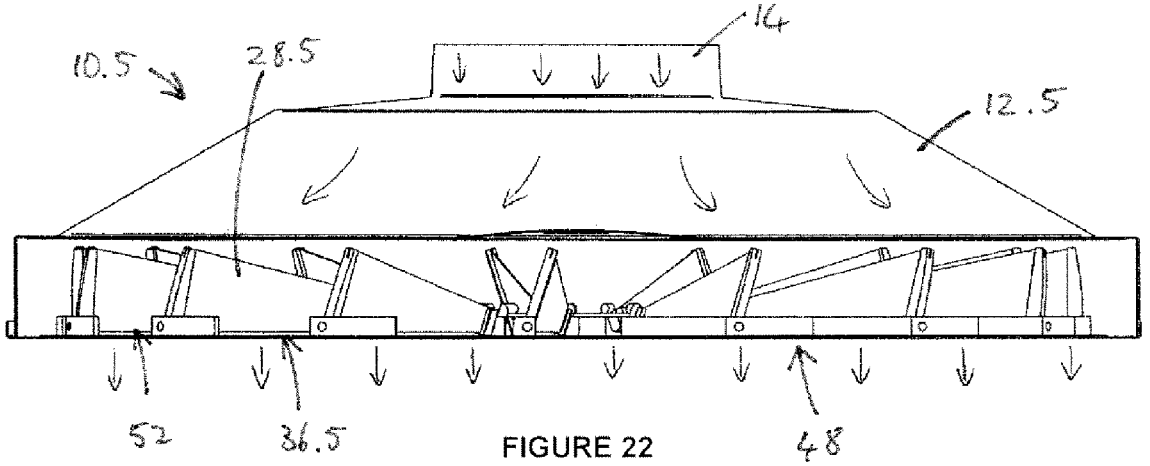
FIG. 22 shows a sectional side view of the diffuser of FIG. 19, in a second diffusion (dumping) condition.
Figure 23:
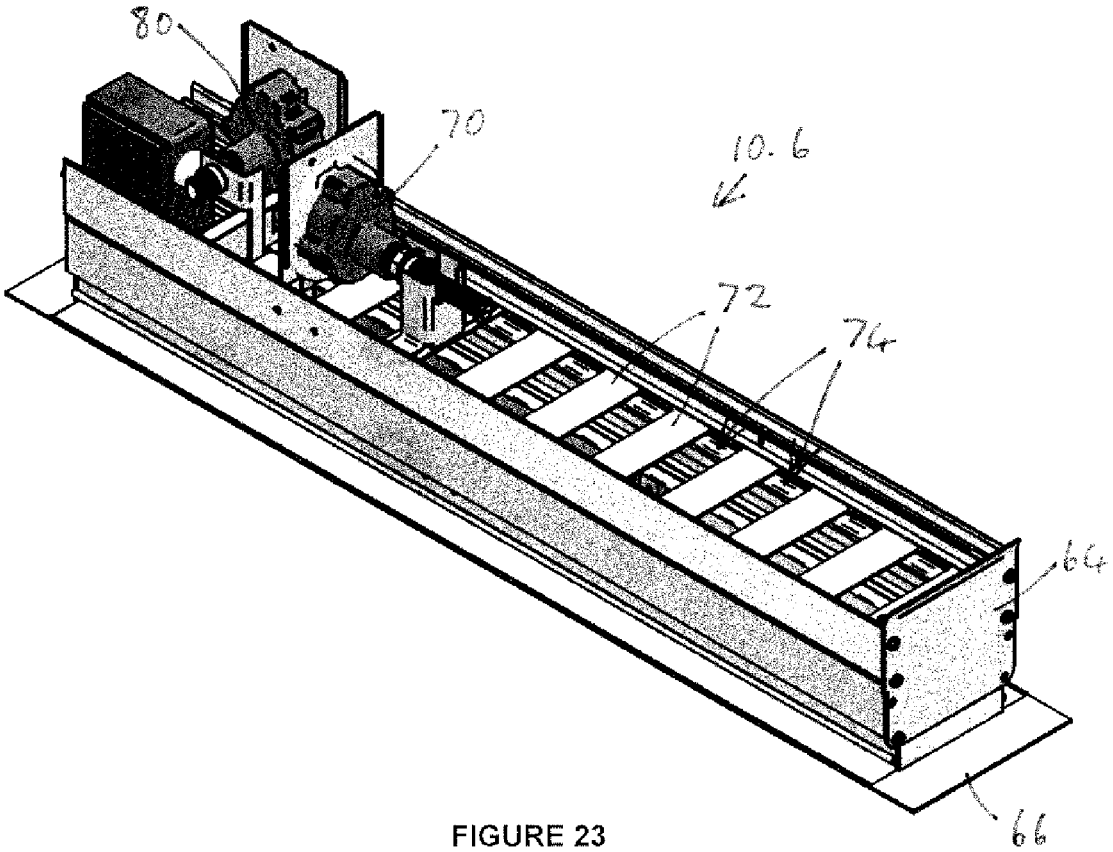
FIG. 23 shows a top three-dimensional view of a sixth embodiment of an air diffuser according to the present invention.
Figure 24:
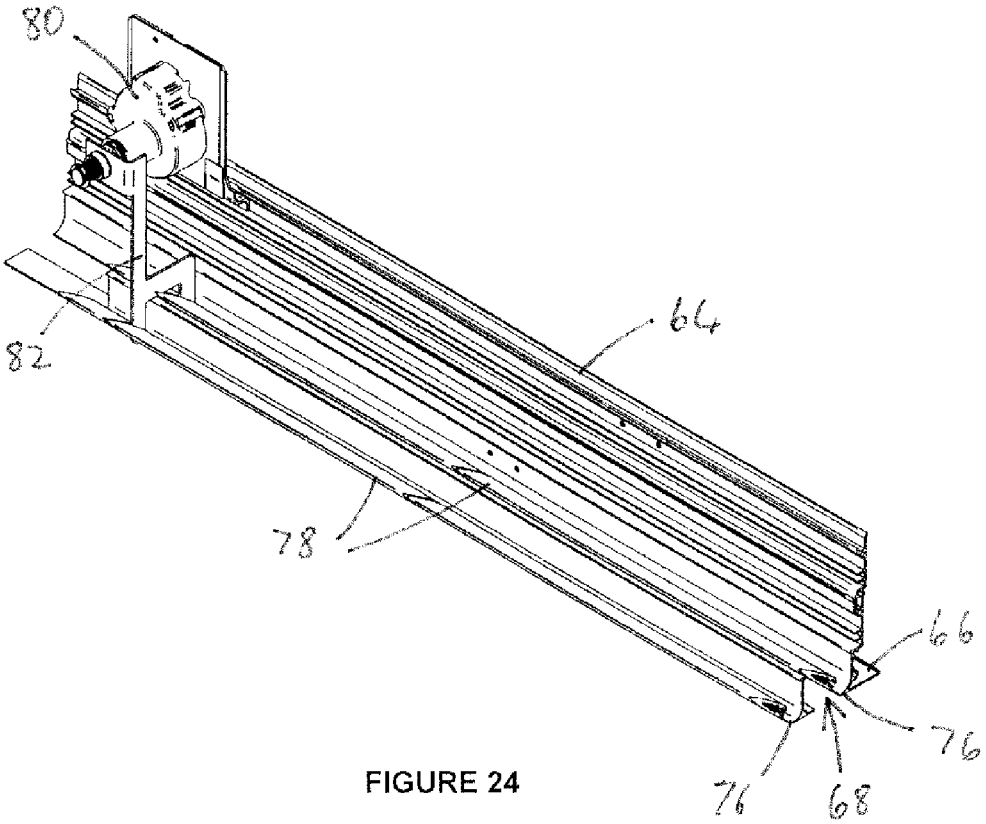
FIG. 24 shows a top three-dimensional view of a dump mechanism of the diffuser of FIG. 23.

During normal operation of the diffuser 10.5, the volume control mechanism is operated to pivot each of the blades 28.5 between its closed position as shown in FIG. 21 and an intermediate position, e.g. the position shown in FIG. 20. The pivoting movement of each blade 28.5 in relation to its associated aperture 52 opens and closes the aperture to restrict and thus control the volumetric flow rate of air through the aperture. The angle of each blade 28.5 relative to the base plate 50 is at a small enough angle for the flow passage along the blade and through its aperture 52 to serve as a diffusion flow passage and for air to leave the aperture in a first diffusion direction and to travel along the underside of the ceiling, as shown in FIG. 20.

In the event that a downward flow of air from the diffuser 10.5 is required, the central disc 54 is lifted further off the base plate 50 so that the blades 28.5 deflect the air flow so that it no longer travels along the ceiling in the first diffusion direction, but air is redirected to flow downwards in a second diffusion direction.

Once the need for downward flow or air from the diffuser 10.5 ceases, central disc 54 is lowered again to pivot the blades 28.5 back to their normal operating positions between their close and intermediate positions, so that normal operation of the diffuser 10.5 can resume.

Referring to FIGS. 23 to 26, the sixth embodiment of an air diffuser 10.6 includes a body in the form of an elongate, rectangular casing 64 with a bottom flange 66 that can be integrated in a ceiling. The top of the casing 64 is open and can receive air from an HVAC system—typically from a box that extends upwards above the casing, but possibly also from a plenum. The inside of the casing 64 forms a control flow passage in which air from the HVAC system flows downwards through outlets 68 on the underside of the casing, into a room below.

The diffuser 10.6 includes a volume control mechanism in the form of a volume control actuator 70 that is configured to slide a moveable element with a series of vanes 72 in relation to stationary vanes (not visible in the drawings) that form part of the casing 64, to adjust the size of the control flow passage, by adjusting control apertures 74 defined between the movable vanes 72 and the stationary vanes.

Below the volume control mechanism, the casing 64 defines a diffusion flow passage, extending from the volume control mechanism, inside the casing and into the room below, through the outlets 68. The casing 64 includes rounded lips 76 that extend along lateral edges of the outlets 68 and two blades 78 are provided inside the casing 64, immediately above the outlets. The blades 78 are normally slanted as shown in FIG. 25, so that air flowing downward in the diffusion flow passage, is directed to flow downwards around the lower edges of the blades and is urged by the lips 76 to exit the outlets 68 in a first diffusion direction that extends generally along the underside of the flange 66—as shown by arrows in FIG. 25.

Figure 25:
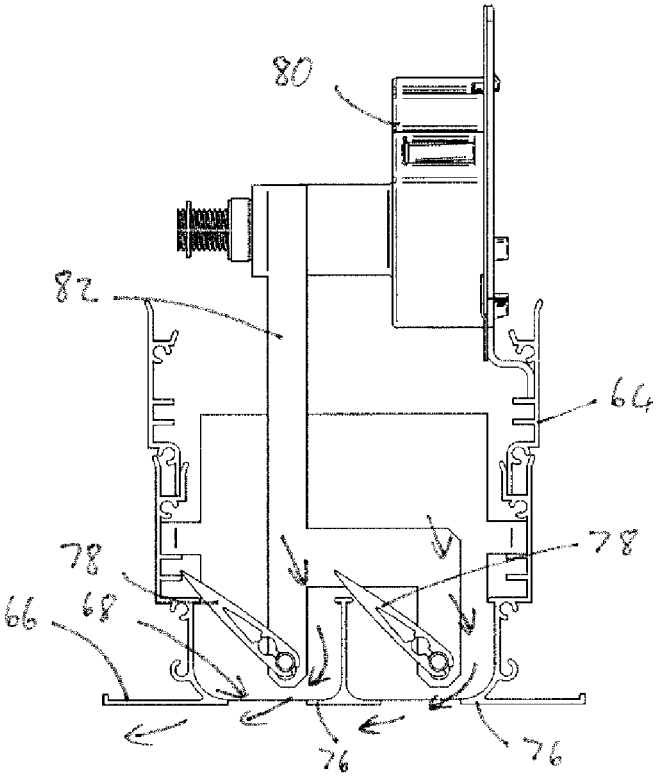
FIG. 25 shows a sectional view of the diffuser of FIG. 23 with dump elements in their diffuser positions.
Figure 26:
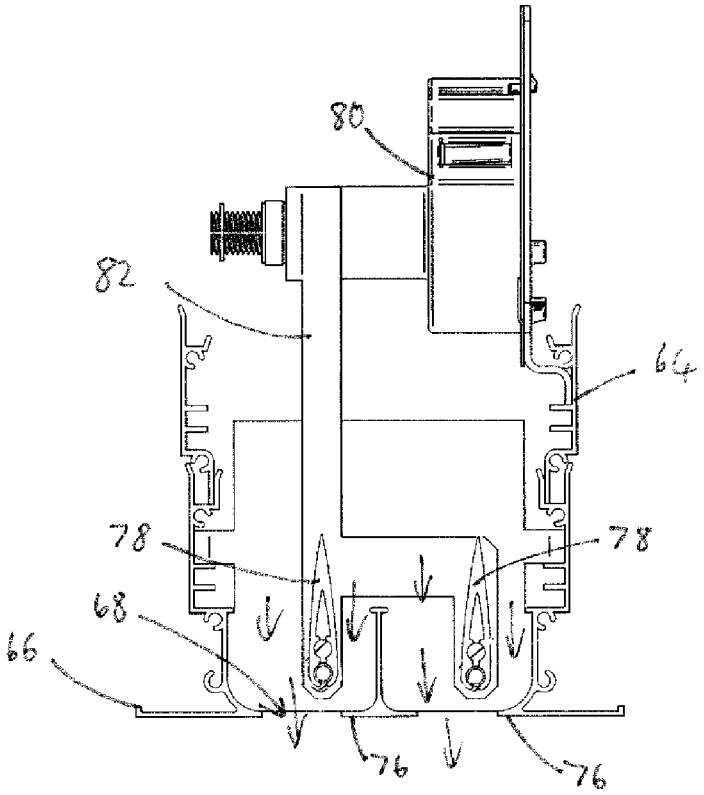
FIG. 26 shows a sectional view of the diffuser of FIG. 23 with dump elements in their second diffusion positions.

The blades 78 also serve as dump elements of a dump mechanism, which includes a dump actuator 80 in the form of a stepper motot that is configured to pivot the blades via a connecting bracket 82 between the slanted, first diffusion position shown in FIG. 25 and a vertical, second diffusion position, shown in FIG. 26.

During normal operation of the diffuser 10.6, the blades 78 are kept in their first diffusion position and the air leaves the diffuser in the first diffusion direction, along the underside of the adjacent ceiling as shown in FIG. 25. However, if a downward flow of air is required, e.g. if rapid heating of a cold room is required, or if the diffuser is required to provide an air curtain or provide heating immediately inside a cold window, then the dump actuator 80 operates to pivot the blades 78 to the second diffusion position shown in FIG. 26. The blades 78 redirect the air to deviate from the horizontal first diffusion direction and to flow downwards into the room in a second diffusion direction.

To cease downward dumping of air, the dump actuator 80 simply pivots the blades 78 to return them to their slanted first diffusion positions.

Figure 27:
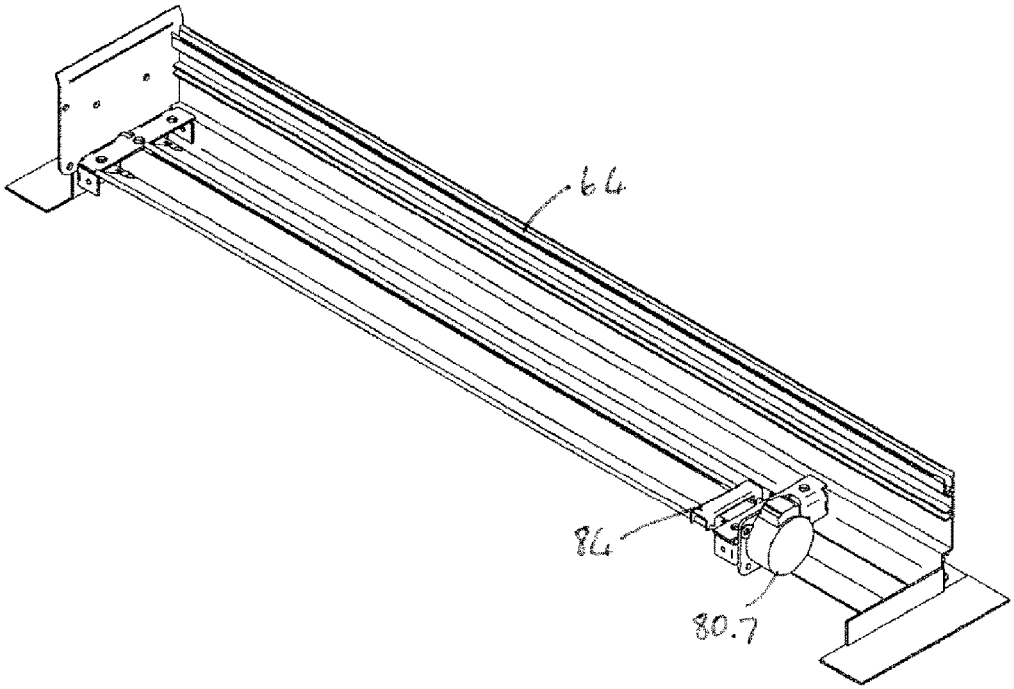
FIG. 27 shows a top three-dimensional view of a dump mechanism of a seventh embodiment of an air diffuser according to the present invention.
Figure 28:
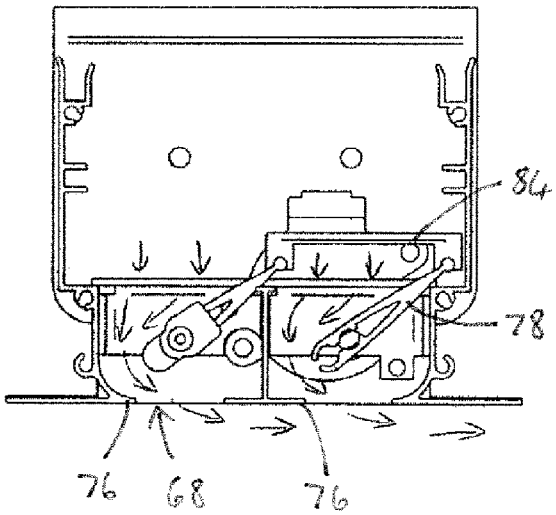
FIG. 28 shows a sectional view of the diffuser of FIG. 27 with dump elements in their diffuser positions.
Figure 29:
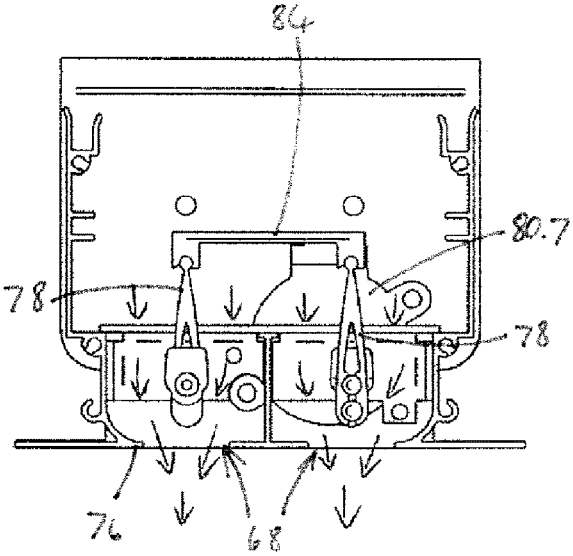
FIG. 29 shows a sectional view of the diffuser of FIG. 27 with dump elements in their second diffusion positions.

Referring to FIGS. 27 to 29, the seventh embodiment of an air diffuser according to the present invention is substantially similar to the sixth embodiment shown in FIGS. 23 to 26, except that the dump actuator is not connected to the blades 78 via a bracket, but instead, the dump mechanism includes a dump actuator 80.7 in the form of a stepper motor with a shaft that is directly connected to one of the blades 78 to serve as pivot axle for the blade and upper edges of the blades are connected with a link 84 to link the blades to pivot together.

The operation of the diffuser of the seventh embodiment is also practically the same as the sixth embodiment, with the blades 78 being slanted during normal operation and air being directed by the lips 76 to exit the outlets 68 in a first diffusion direction, along the ceiling, as shown in FIG. 28, and the blades being pivoted upwards when dumping is required, to direct the air flow downwards in a second diffusion direction as shown in FIG. 29.

The invention claimed is:

1. An air diffuser comprising:

a body defining at least one control flow passage that extends from an inlet of the control flow passage to an outlet of the control flow passage;

a volume control mechanism including at least one movable element that is displaceable relative to the body inside the control flow passage, to adjust the size of the control flow passage for control of a volumetric flow rate of air through the control flow passage;

said body defining at least one diffusion flow passage that is in communication with the outlet of the control flow passage and that is configured to direct flow from the outlet of the control flow passage to flow outwards in a first diffusion direction; and a dump mechanism comprising at least one dump element that is disposed in the diffusion flow passage and is displaceable between a first diffusion position in which the diffusion flow passage is directed in the first diffusion direction, and a second diffusion position in which the dump element redirects the diffusion flow passage to deviate from the first diffusion direction and disrupt the outward flow.

2. The air diffuser according to claim 1, in which the second diffusion position of the dump element is within the diffusion flow passage.

3. The air diffuser according to claim 2, in which the first diffusion position is a retracted position in which the dump element is substantially clear from the diffusion flow passage and the second diffusion position is an extended position in which the dump element protrudes at least partly into the diffusion flow passage.

4. The air diffuser according to claim 3, in which the dump element is retracted into the body in the first diffusion position and protrudes from the body in the second diffusion position.

5. The air diffuser according to claim 1, in which the dump element is disposed inside the diffuser body and is pivotally supported to pivot between its first diffusion position and its second diffusion position.

6. The diffuser according to claim 5, in which the dump element closes a second flow passage at least in part, and restricts a flow of air to the diffusion flow passage when the dump element is in the first diffusion position, and opens the second flow passage and permits the flow of air to deviate, at least in part, from the diffusion flow passage to the second flow passage when the dump element is in the second diffusion position.

7. The air diffuser according to claim 1, in which the dump mechanism includes a dump actuator that is configured to displace the dump element between the first diffusion position and the second diffusion position.

8. The air diffuser according to claim 7, in which the dump element is biased to the first diffusion position.

9. A method of controlling a flow of air through a diffuser, said method comprising:

supplying a flow of air to a diffuser;

directing the flow of air through a control flow passage;

controlling the volumetric flow rate of the flow of air by displacing a movable element in the control flow passage to adjust the size of the control flow passage;

directing the flow of air from an outlet of the control flow passage, through a diffusion flow passage;

directing the flow of air from the diffusion flow passage outwards in a first diffusion direction;

selectively operating a dump mechanism to displace a dump element from a first diffusion position in which the flow of air is directed outwards in the first diffusion direction, to a second diffusion position in which the dump element redirects the flow of air to deviate from the first diffusion direction and to disrupt the outward flow.

10. The method according to claim 9 in which the first diffusion direction extends in the proximity of a ceiling and the step of operating the dump mechanism includes displacing the dump element to the second diffusion position to redirect the flow of air away from the ceiling.

11. The method according to claim 9, which includes controlling the volumetric flow rate while the flow of air is deviated from the first diffusion direction by the dump element.

12. The method according to claim 10, which includes controlling the volumetric flow rate while the flow of air is deviated from the first diffusion direction by the dump element.

* * * * *